US008944278B2

(12) United States Patent
Chohfi et al.

(10) Patent No.: US 8,944,278 B2
(45) Date of Patent: Feb. 3, 2015

(54) CLIP-ON HANDLE GRIPS

(75) Inventors: William Chohfi, Porto (PT); Carlos Aguiar, Burgo (PT)

(73) Assignee: AMTROL Licensing Inc., West Warwick, RI (US)

( * ) Notice: Subject to any disclaimer, the term of this patent is extended or adjusted under 35 U.S.C. 154(b) by 485 days.

(21) Appl. No.: 13/076,820

(22) Filed: Mar. 31, 2011

(65) Prior Publication Data

US 2012/0248128 A1 Oct. 4, 2012

(51) Int. Cl.
*B65D 25/10* (2006.01)
*B65D 25/22* (2006.01)

(52) U.S. Cl.
CPC ..... *B65D 25/22* (2013.01)
USPC ..... 220/769; 220/770; 220/724; 220/581; 137/382

(58) Field of Classification Search
USPC ..... 220/759, 760, 775, 773, 642, 769, 776, 220/779, 592, 770, 581; 294/27.1, 15, 294/32–34, 158, 137, 145, 171; 16/110.1, 16/410, 411, 422–428; 206/0.6
See application file for complete search history.

(56) References Cited

U.S. PATENT DOCUMENTS

| | | | | |
|---|---|---|---|---|
| D201,962 | S | 8/1965 | Hammesfahr et al. | |
| D210,374 | S | 3/1968 | Schaefer et al. | |
| 4,600,033 | A * | 7/1986 | Baron | 137/382 |
| 4,890,355 | A * | 1/1990 | Schulten | 16/421 |
| 5,004,117 | A * | 4/1991 | Kitsuda | 220/724 |
| 5,133,472 | A * | 7/1992 | Koda et al. | 220/769 |
| 5,279,443 | A * | 1/1994 | Koda et al. | 220/769 |
| 5,287,991 | A * | 2/1994 | Koda et al. | 220/769 |
| D356,021 | S | 3/1995 | Hull et al. | |
| 5,738,401 | A * | 4/1998 | Fan | 294/171 |
| 6,386,384 | B1 | 5/2002 | Chohfi et al. | |
| D460,519 | S | 7/2002 | Chohfi et al. | |
| 6,536,820 | B1 * | 3/2003 | Dean et al. | 294/159 |
| 6,808,105 | B2 * | 10/2004 | Lee | 229/117.25 |
| D514,422 | S | 2/2006 | Lai | |
| 7,305,738 | B2 * | 12/2007 | Nawrocki | 16/428 |
| D559,348 | S | 1/2008 | Dias et al. | |
| 7,861,380 | B2 * | 1/2011 | Moore et al. | 16/421 |
| 2007/0246959 | A1 * | 10/2007 | Arcaro et al. | 294/171 |

* cited by examiner

*Primary Examiner* — Andrew Perreault
(74) *Attorney, Agent, or Firm* — Edwards Wildman Palmer LLP; Scott D. Wofsy; George N. Chaclas

(57) ABSTRACT

A clip-on handle grip increases the surface area of a handle. The clip-on handle grip includes a grip body configured and adapted to engage a handle. A lock member is engaged with the grip body, for locking the engagement of the grip body with a handle. Such a clip-on handle grip can be used to improve ergonomics, the therefore to improve portability, for pressurized gas cylinders.

10 Claims, 17 Drawing Sheets

Fig. 12
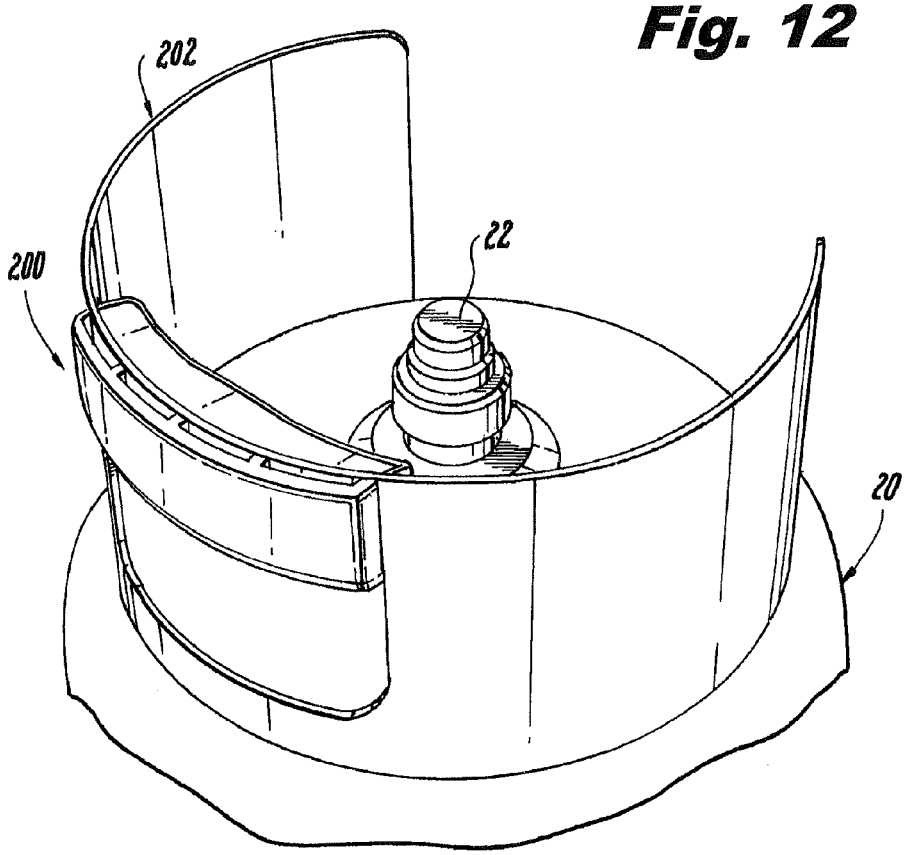
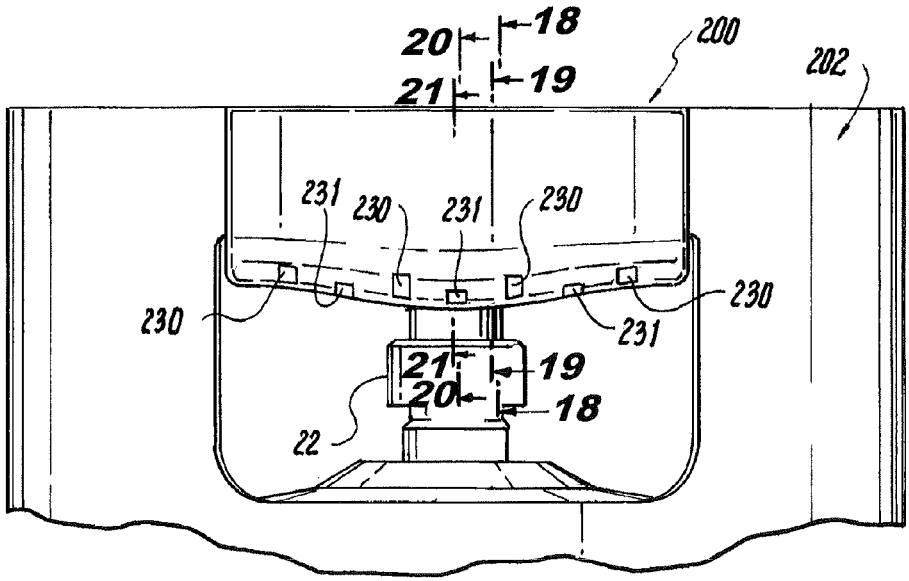
Fig. 13

CLIP-ON HANDLE GRIPS

BACKGROUND OF THE INVENTION

1. Field of the Invention

The present invention relates to handle grips, and more particularly to clip-on handle grips for portable pressurized gas cylinders.

2. Description of Related Art

A variety of pressurized gas cylinders have been used for storage and transportation of pressurized gas products for household and industrial uses. Many of these cylinders have traditionally been fabricated of steel. One problem for steel pressure cylinders has been portability. For steel cylinders, any handles provided are typically formed from the same steel material as the cylinder itself. Due to the properties of steel, these traditional handles have been problematic. The hardness of steel makes it unyielding when gripped, and makes it difficult to form ergonomic surfaces, all of which makes the traditional steel cylinders painful to handle, especially when filled to maximum capacity. Attempts to form an ergonomic handle from steel have generally been limited by practicality due to the difficulty and expense involved. It is difficult and expensive to form a handle volume from a typical metallic shroud that adequately fills the hand for optimal ergonomics. The lack of volume in typical steel handles causes the contact zone of the cylinder with the hand to be too small. The weight distribution on the hand is therefore concentrated in a small area of the hand, which makes traditional cylinders painful and/or makes them effectively heavier than they actually are due to practical limitations on how much weight can be lifted comfortably by hand with such handles.

Such conventional methods and systems have generally been considered satisfactory for their intended purpose. However, there is still a need in the art for handle grips that allow for improved ergonomics, and therefore to improved portability. There also remains a need in the art for such grips that is easy and cost effective to manufacture and install. The present invention provides a solution for these problems.

SUMMARY OF THE INVENTION

The subject invention is directed to a new and useful clip-on handle grip for increasing the surface area of a handle. The clip-on handle grip includes a grip body configured and adapted to engage a handle. A lock member is engaged with the grip body, for locking the engagement of the grip body with a handle.

In certain embodiments, the grip body includes a lengthwise slot configured to receive a handle when engaged therewith, wherein the slot is arcuate for accommodating an arcuate handle. The grip body can include a plurality of inboard clips each configured to clip into a clip receptacle in the handle from a first side of the grip body. The lock member can include a plurality of clip locks each configured to engage and prevent a respective one of the inboard clips of the grip body from backing out of a clip receptacle to lock the grip body onto the handle.

It is also contemplated that the grip body can include a plurality of outboard clips configured to clip into at least one clip receptacle in a handle from a second side of the grip body opposite the first side thereof. The lock member can include a plurality of clip members configured to clip onto the handle. At least one of the grip body and the lock member can include an exterior ergonomic surface.

A plurality of apertures can be defined through at least one of the grip body and the lock member for accommodating a tool to disengage one or more of the grip body and lock member. A first plurality of apertures can be defined between the handle and the grip body, and a second plurality of apertures can be formed through the grip body opposed to the first plurality of apertures.

In certain embodiments, the grip body includes a plurality of stop surfaces, and the lock member includes a plurality of stop surfaces. Each stop surface of the grip body is configured to abut a corresponding one of the stop surfaces of the lock member to prevent over engagement of the lock member with the grip body. The grip body can include a plurality of stop surfaces configured to abut the handle to prevent over engagement of the grip body with the handle.

The invention also provides a cylinder for storing pressurized gas. The cylinder includes a cylinder body configured and adapted to store pressurized gas. A handle extends from the cylinder body. A grip body as described above is engaged with the handle. A lock member, as described above is engaged with the grip body. The handle, grip body, and lock member can all be arcuate in a lengthwise direction thereof.

The invention also provides a kit for a clip-on handle grip for increasing the surface area of a handle. The kit includes a grip body and a lock member as described above.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 12 is a perspective view of another exemplary embodiment of a pressurized gas cylinder with handle and grip constructed in accordance with the present invention, showing the grip body and lock member engaged to the handle;

FIG. 13 is an elevation view of the handle and grip of FIG. 12, showing the apertures through the grip body;

DETAILED DESCRIPTION OF THE PREFERRED EMBODIMENTS

Figure 1A:
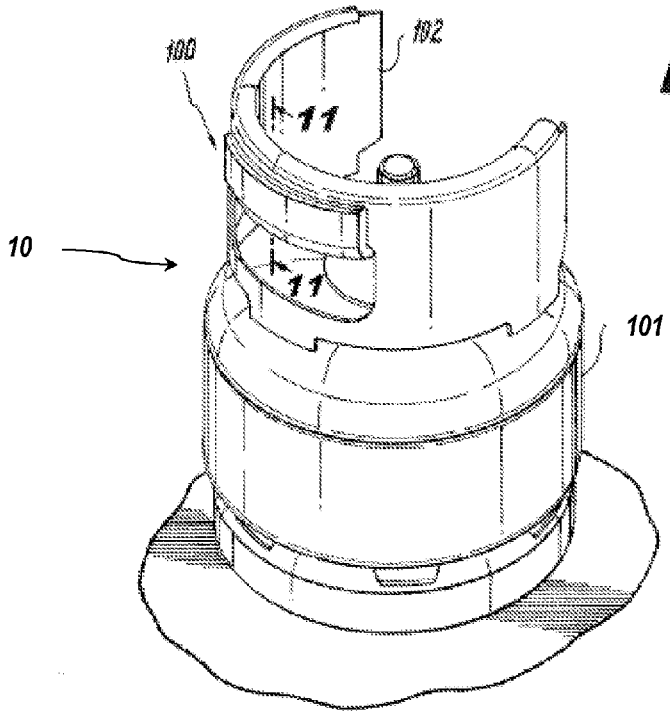
FIG. 1*a* is a perspective view of an exemplary embodiment of a pressurized gas cylinder constructed in accordance with the present invention, showing the handle and grip for handling the cylinder.
Figure 1B:
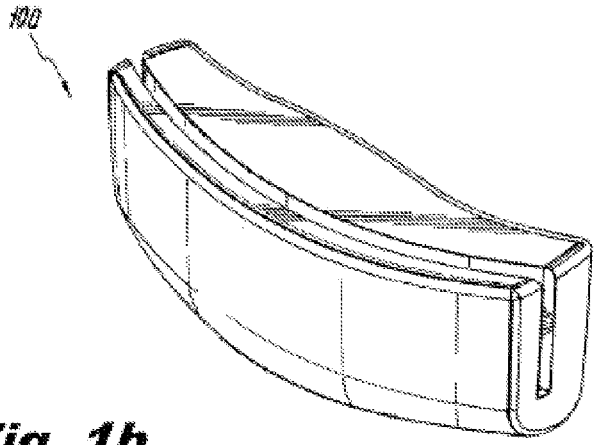
FIG. 1*b* is a perspective view of the grip of FIG. 1*a*, showing the grip separated from the pressurized gas cylinder.
Figure 1C:
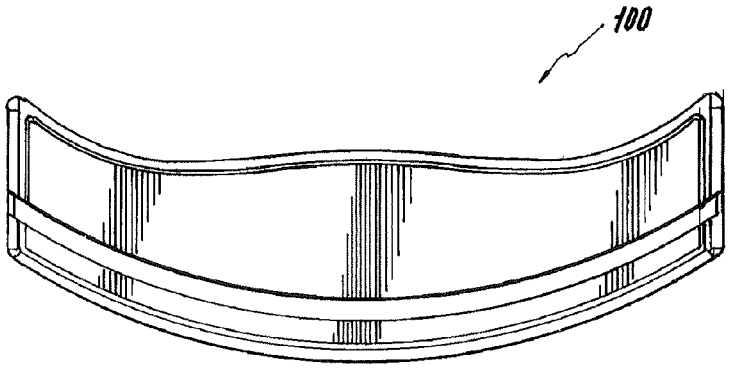
FIG. 1*c* is a plan view of the grip of FIG. 1*b*, showing the grip viewed from above, as oriented in FIG. 1*a;*
Figure 1D:
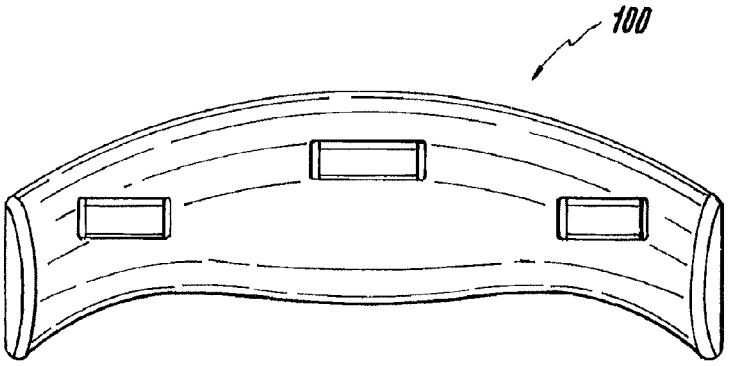
FIG. 1*d* is a bottom view of the grip of FIG. 1*b*, showing the apertures through the lock member.
Figure 1E:
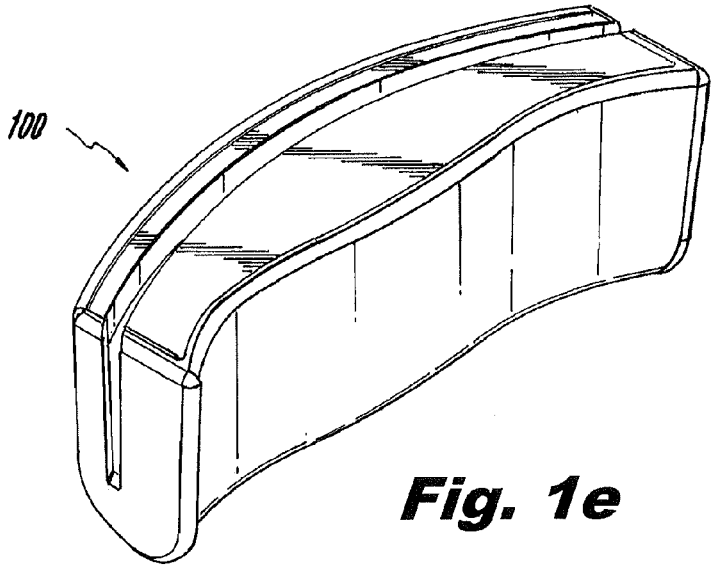
FIG. 1*e* is a perspective view of the grip of FIG. 1*a*, showing the grip as viewed from inboard.

Reference will now be made to the drawings wherein like reference numerals identify similar structural features or aspects of the subject invention. For purposes of explanation and illustration, and not limitation, a partial view of an exemplary embodiment of a handle grip in accordance with the invention is shown in FIG. 1*a* and is designated generally by reference character 100. Other embodiments of handle grips in accordance with the invention, or aspects thereof, are provided in FIGS. 1*b*-23, as will be described. The system of the invention can be used to improve ergonomics and portability of pressurized gas cylinders, for example.

Referring now to FIG. 1*a*, pressure cylinder 10 is generally of a steel construction and includes handle 102 extending from the main cylinder body 101, which is configured to store pressurized gas. Handle 102 is combined with a shroud that serves to protect the valve connection in addition to providing a hand hold for handling pressure cylinder 10. Clip-on handle grip 100 increases the surface area of handle 102 to improve ergonomics and portability for handling pressure cylinder 10, effectively softening handle 102 and making pressure cylinder 10 have a lower apparent weight for handling. FIGS. 1*b*-1*e* show grip 100 separate from pressure cylinder 10 from a perspective outboard, in a plan view from above, and in a bottom view, and form a perspective inboard (all as oriented in FIG. 1*a*), respectively.

Figure 2:
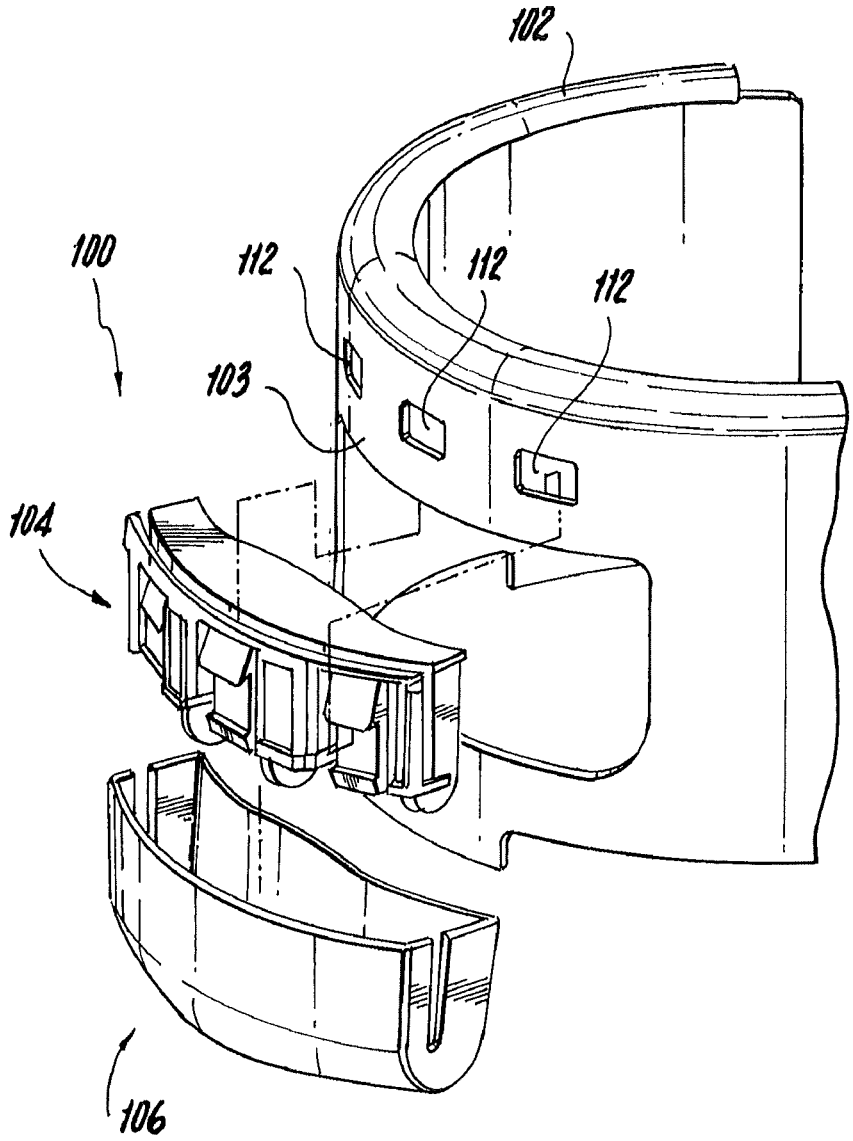
FIG. 2 is an exploded perspective view of the handle of FIG. 1, showing the grip body and lock member disengaged from the handle.

With reference now to FIG. 2, grip 100 includes a grip body 104 which is configured and adapted to engage handle 102. A lock member 106 engages grip body 104, for locking the engagement of grip body 104 with handle 102, as described below.

Figure 3:
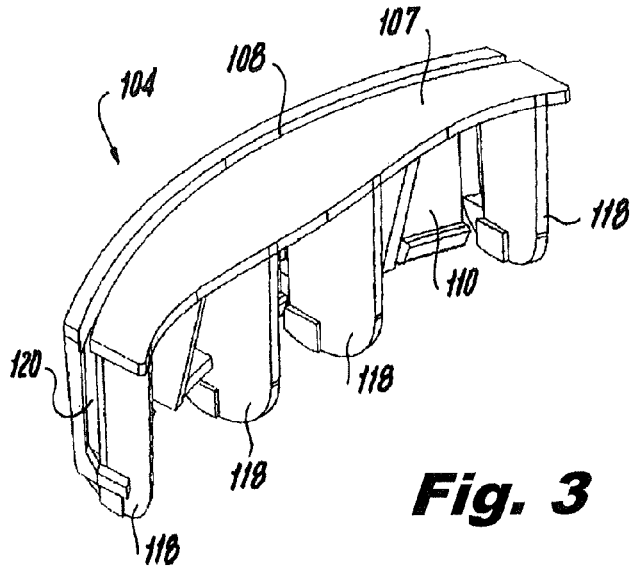
FIG. 3 is a perspective view of the grip body of FIG. 2, showing the bulkheads and clips of the grip body.
Figure 4:
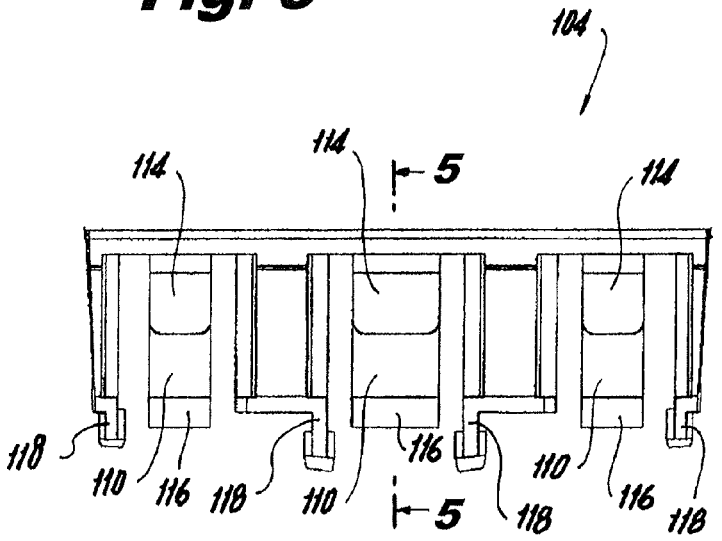
FIG. 4 is an elevation view of the grip body of FIG. 2, showing the bulkheads and clips of the grip body as viewed from outboard.
Figure 5:
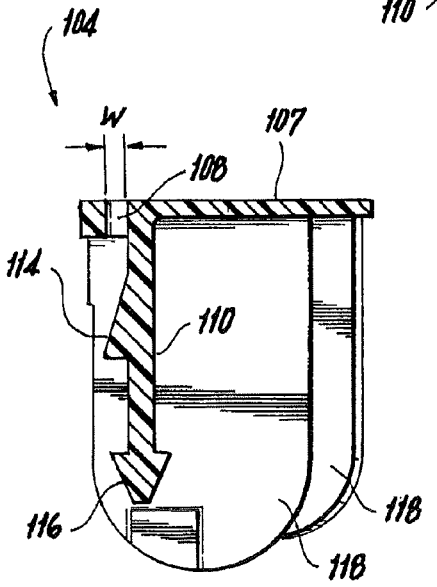
FIG. 5 is an cross-sectional elevation view of the grip body of FIG. 2, showing one of the clips in cross-section.

Referring now to FIGS. 3-5, grip body 104 includes a lengthwise slot 108 configured to receive a corresponding portion 103 of handle 102 when engaged therewith (as indicated in FIG. 2), and slot 108 is arcuate to match the arcuate corresponding portion 103 of handle 102. FIG. 3 shows the lengthwise portion of slot 108 defined in the upper surface 107 of grip body 104, as oriented in FIG. 3. Slot 108 has a substantially constant width w, indicated in FIG. 5, along its length. Grip body 104 includes three inboard clips 110 each configured to clip into a respective clip receptacle 112 (shown in FIG. 2) in handle 102 from a first side of grip body 104.

With continued reference to FIG. 4, each clip 110 includes an upper clip portion 114, which passes into a respective clip receptacle 112 (shown in FIG. 2) of handle 102. Each clip 110 also includes a clip end 116, which is configured to engage portion 103 of handle 102 (shown in FIG. 3) from inboard thereof, and to engage a clip of lock member 106 from outboard thereof as described below. As shown in FIG. 5, clip ends 116 have a generally arrowhead shaped cross-section. The portions of clip ends 116 that engage handle 102 provide stop surfaces to prevent over engagement of grip body 104 when attaching to handle 102. In other words, clip ends 116 prevent grip body 104 sliding too far upward relative to handle 102, as oriented in FIG. 2. Grip body 104 also includes bulkhead members 118 between adjacent clips 110 and on each end of grip body 104 for providing rigidity to handle 100. Each bulkhead member 118 has a slot 120 defined therein for receiving portion 103 of handle 102 (shown in FIG. 2). Slots 120 are contiguous with and form portions of lengthwise slot 108.

Figure 6:
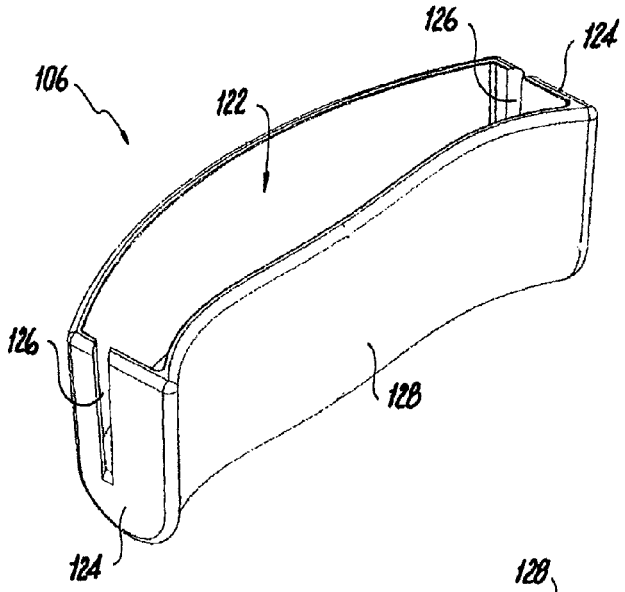
FIG. 6 is a perspective view of the lock member o the FIG. 2, showing the main opening into the lock member for receiving the grip body.
Figure 7:
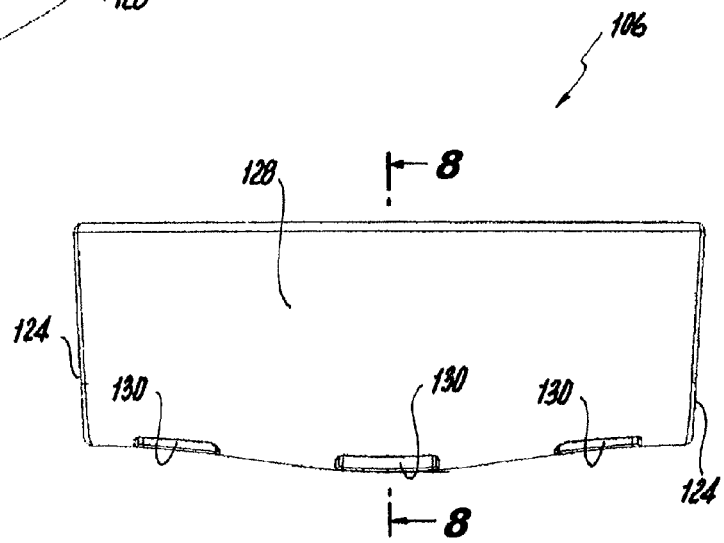
FIG. 7 is an elevation view of the lock member of FIG. 2, showing the apertures opposite the main opening as viewed from outboard.
Figure 8:
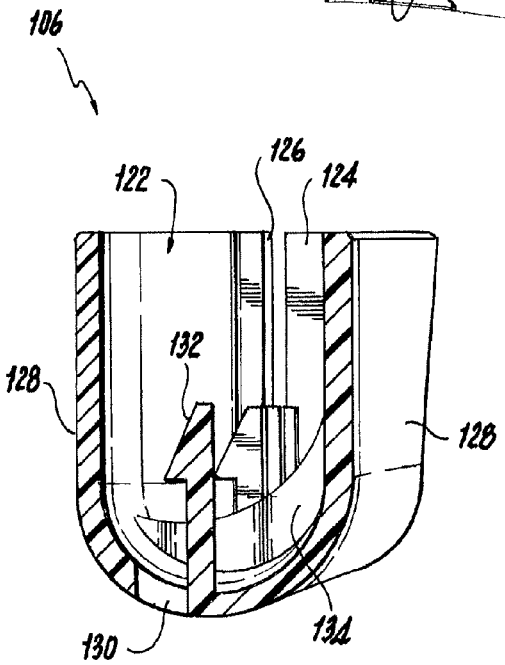
FIG. 8 is a cross-sectional elevation view of the lock member of FIG. 2, showing one of the clips for engaging and preventing a clip of the grip body from backing out of the clip receptacle of the handle.

Referring now to FIGS. 6-8, lock member 106 includes a main opening 122 for receiving handle 102 and grip body 104 as indicated in FIG. 2. As shown in FIG. 6, the end walls 124 of lock member 106 include slots 126, which correspond to slots 120 of grip body 104 described above, for receiving portion 103 of handle 102 (shown in FIG. 2). Lock member 106 includes an exterior ergonomic surface 128 which increases the surface area and comfort of handle 102 when assembled thereon. Apertures 130, shown in FIG. 7, are configured to receive a tool used for removing grip body 104 and lock member 106 from handle 102. FIG. 7 is how grip 100 appears when assembled separate from pressure cylinder 10 as viewed from outboard.

As shown in FIG. 8, lock member 106 includes clips 132, each of which is positioned to engage the inboard portion of a respective one of the clip ends 116 to lock the respective clip 110 of grip body 104 in place within receptacle 112 of handle 102. This keeps clips 110 from backing out of engagement with the respective receptacles 112. Between adjacent clips 132, lock member 106 includes bulkheads 134.

Figure 9:
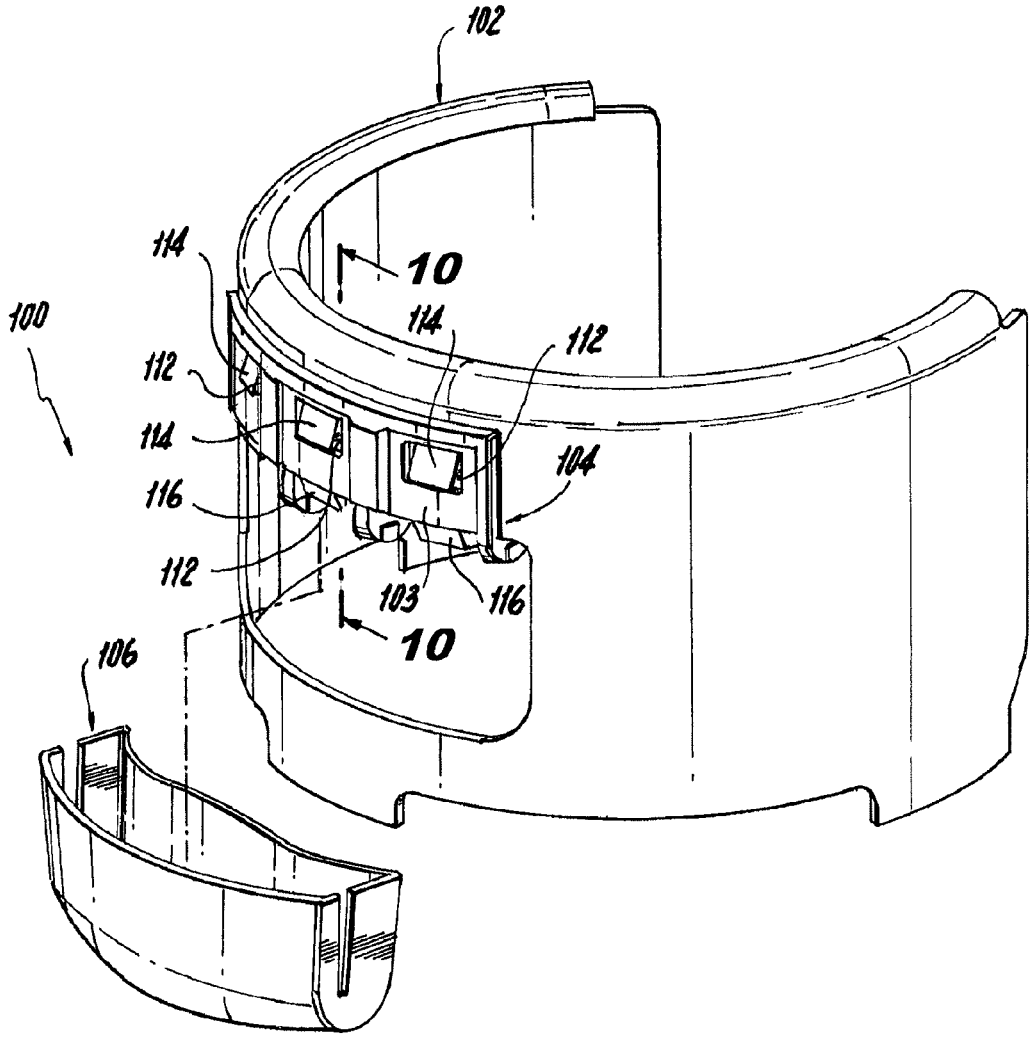
FIG. 9 is a perspective view of the handle, grip body, and lock member of FIG. 2 showing the clips of the grip body engaging the respective clip receptacles of the handle with the lock member separated from the grip body.
Figure 10:
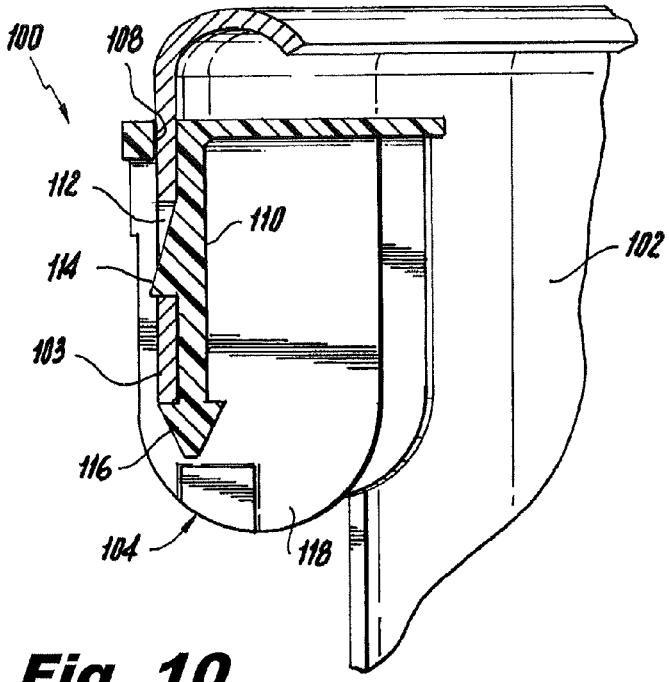
FIG. 10 is a cross-sectional elevation view of the handle and grip body of FIG. 9, showing the engagement of one of the clips of the grip body with one of the receptacles of the handle.

Referring now to FIG. 9, to engage grip 100 with handle 102, grip body 104 is slid onto handle 102 with portion 103 of handle 102 inserted into lengthwise slot 108 (shown in FIG. 3). Clips 110 cam along the inboard surface of portion 103 of handle 102 until upper clip portions 114 clip into place in their respective clip receptacles 112. This also allows clip ends 116 to engage portion 103 of handle 102. FIG. 10 shows the engagement of clip end 116 and upper clip portion 114 with portion 103 of handle 102.

Figure 11:
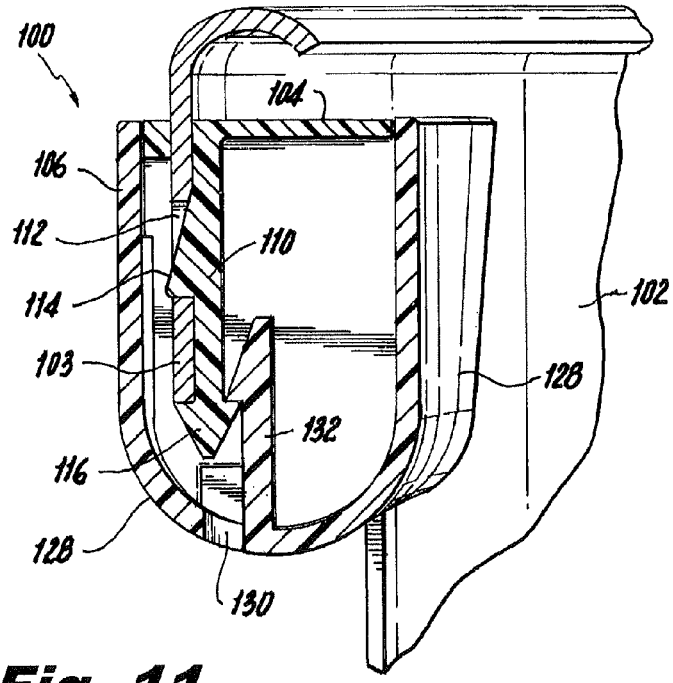
FIG. 11 is a cross-sectional elevation view of the handle, grip body, and lock member of FIG. 9, showing the lock member engaged to the handle and grip body, with one of the clips of the lock member locking one of the clips of the grip body in one of the clip receptacles of the handle.

With reference now to FIGS. 9 and 11, once grip body 104 is engaged to handle 102 as shown in FIG. 9, lock member 106 can be slid over grip body 104 and handle 102 to lock grip body 104 in place, as shown in FIG. 11. When clips 132 of lock member 106 are engaged with clip ends 116, the engagement prevents clip ends 116 and upper clip portions 114 from disengaging handle 102 under force, since clips 132 resists inward deflection of clips 110. Grip 100 can be removed from handle 102 by inserting a tool, such as a screwdriver or a custom tool into each of the apertures 130 through lock member 106, manipulating clips 132 to disengage from clip ends 116, and sliding lock member 106 downward (as oriented in FIG. 11) to remove it from grip body 104 and handle 102. Thereafter, grip body 104 can be disengaged from handle 102 by depressing upper clip portions 114 inward to clear clip receptacles 112, and then sliding grip body 104 downward (as oriented in FIG. 11) and off of handle 102.

Figure 14:
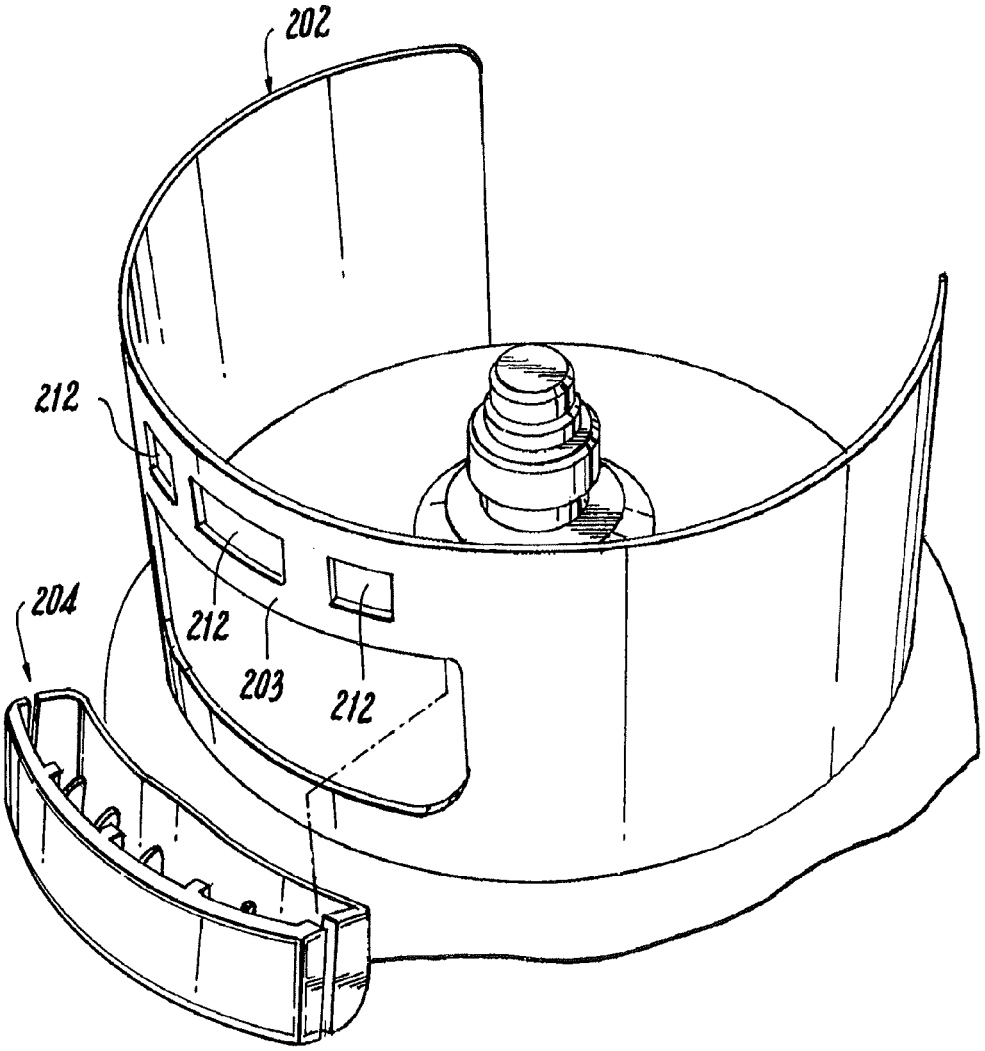
FIG. 14 is a perspective view of the handle and grip body of FIG. 12, showing the grip body separated from the handle.

Referring now to FIGS. 12 and 13, another exemplary embodiment of a grip 200 is shown attached to a handle 202 of a pressurized gas cylinder 20. As described above, handle 202 provides a place for gripping and handling cylinder 20, as well as protecting valve 22. As shown in FIG. 14, handle 202 includes three clip receptacles 212 adjacent portion 203 of handle 202 that receives grip body 204.

Figure 15:
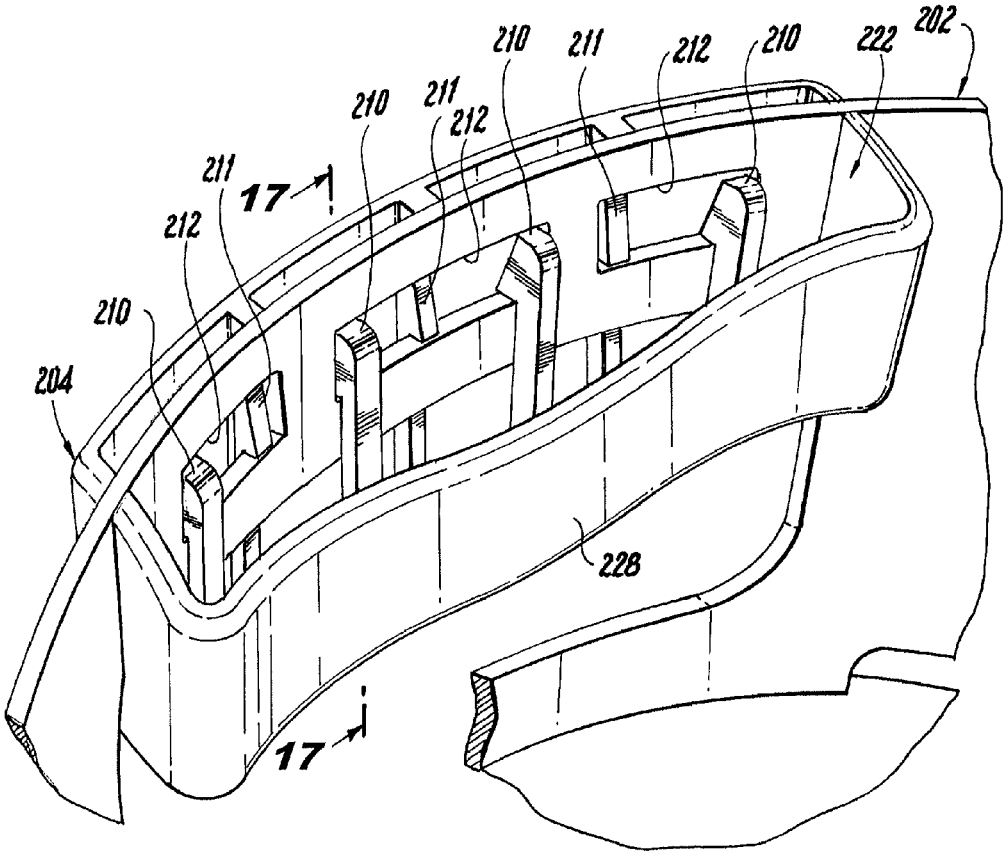
FIG. 15 is a perspective view of the handle and grip body of FIG. 12, showing the clips of the grip body engaging the clip receptacles of the handle.

With reference now to FIG. 15, grip body 204 includes four inboard clips 210, much like clips 110 described above, which clip into receptacles 212 from the inboard side of grip body 204. The center two clips 210 share a common receptacle 212. Grip body 204 also includes three outboard clips 211, each configured to clip into a respective clip receptacle 212 from the outboard side of the grip body 204 opposite the inboard side thereof. In this manner, grip body 204 engages clip receptacles 212 from inboard and from outboard. Grip body 204 includes a main opening 222 configured to receive lock member 206 as described below. Grip body 204 includes an exterior ergonomic surface 228, much as surface 128 described above.

Figure 16:
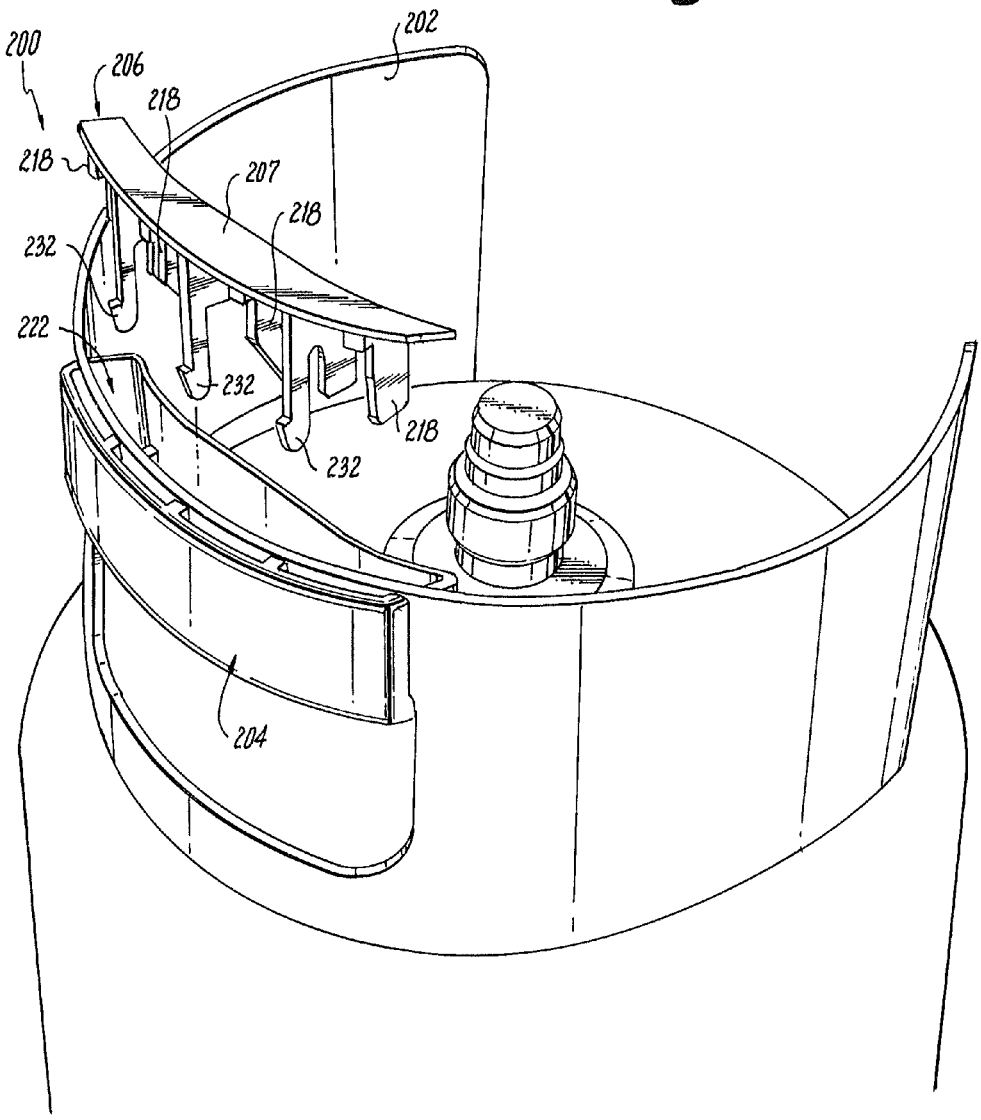
FIG. 16 is a perspective view of the handle, grip body, and lock member of FIG. 12, showing the lock member separated from the handle and grip body.

Referring now to FIG. 16, lock member 206 can be inserted into main opening 222 of grip body 204 to form grip 200 and lock the engagement of grip body 204 with handle 202. Lock member 206 includes three clips 232 and four bulkheads 218, and includes an upper surface 207 which covers the majority of opening 222 when assembled.

Figure 17:
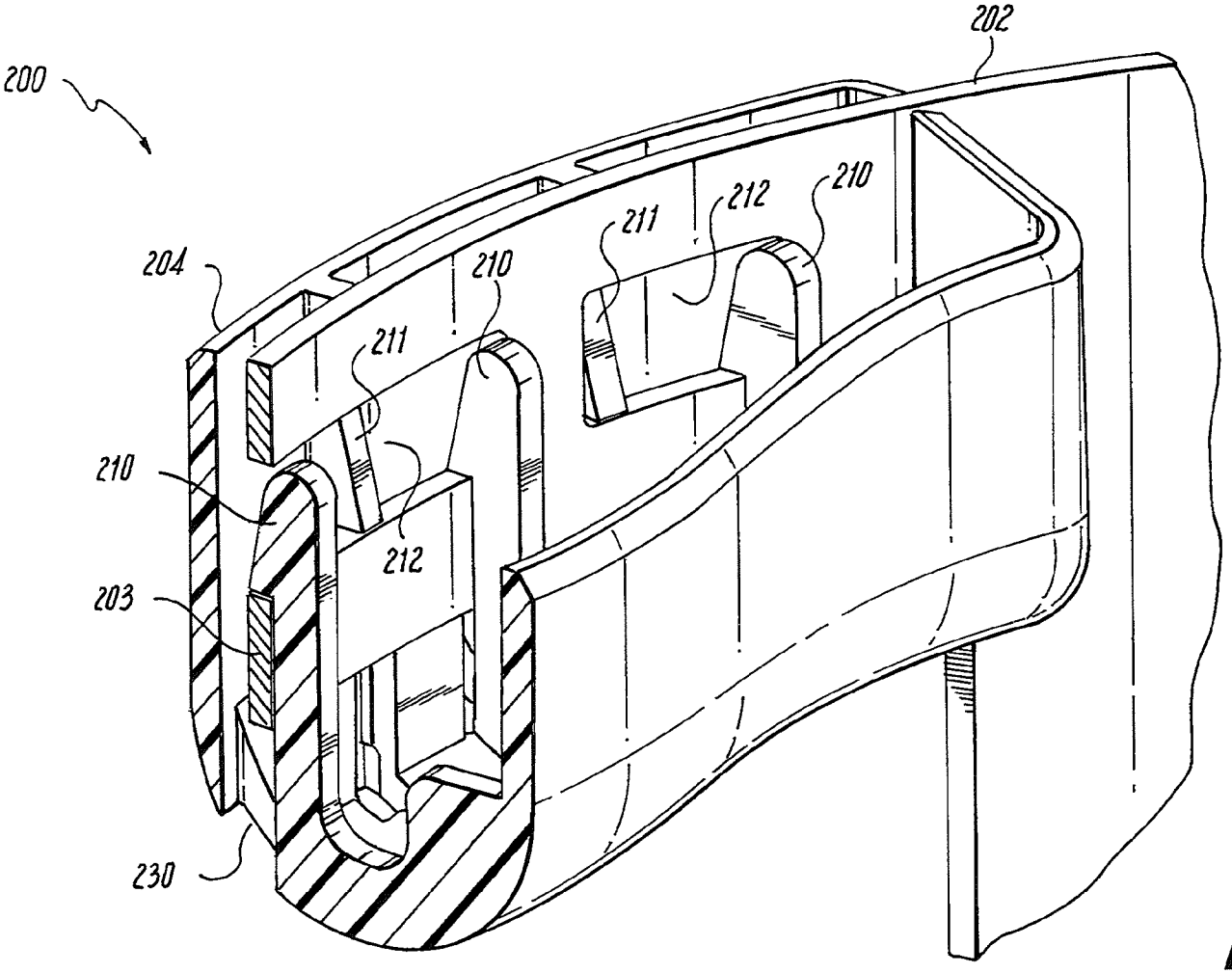
FIG. 17 is a cross-sectional perspective view of the handle and grip body of FIG. 12, showing one of the clips of the grip body engaging one of the clip receptacles of the handle.
Figure 18:
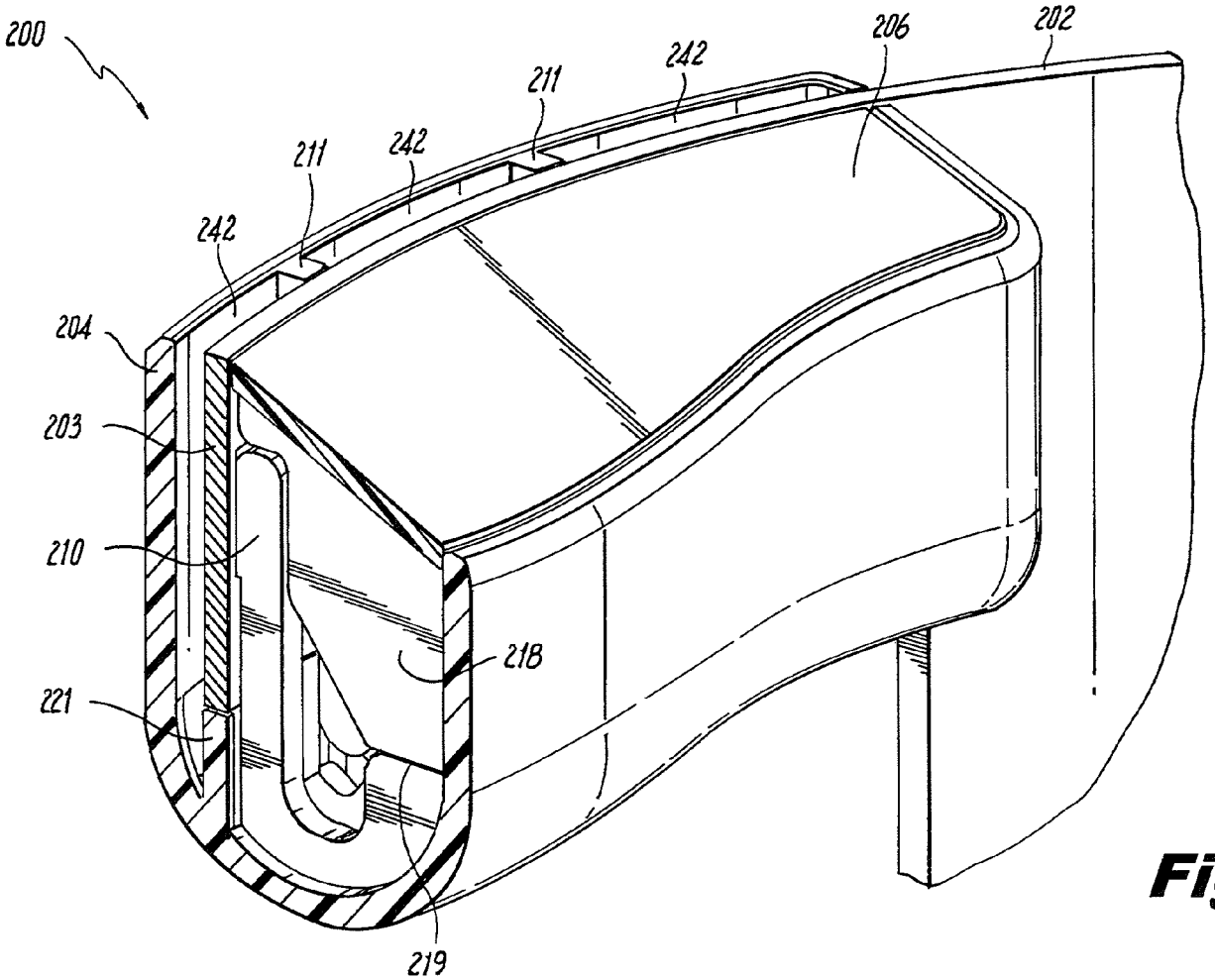
FIG. 18 is a cross-sectional perspective view of the handle, grip body, and lock member of FIG. 12, showing one of the stop surfaces of the grip body engaging the handle, preventing over engagement of the grip body with the handle.
Figure 19:
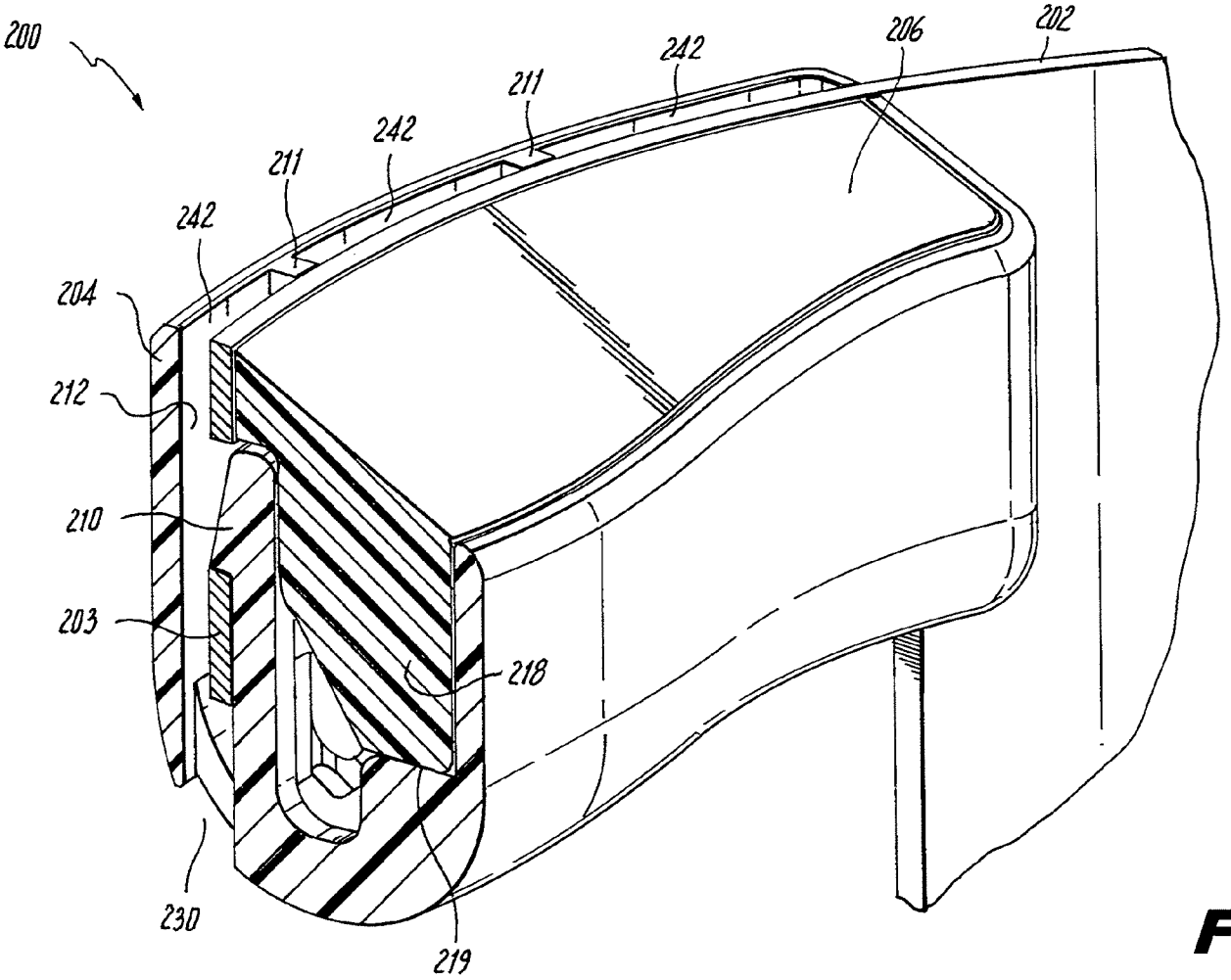
FIG. 19 is a cross-sectional perspective view of the handle, grip body, and lock member of FIG. 12, showing the lock member engaging one of the clips of the grip body, preventing the same from disengaging the clip receptacle of the handle.
Figure 20:
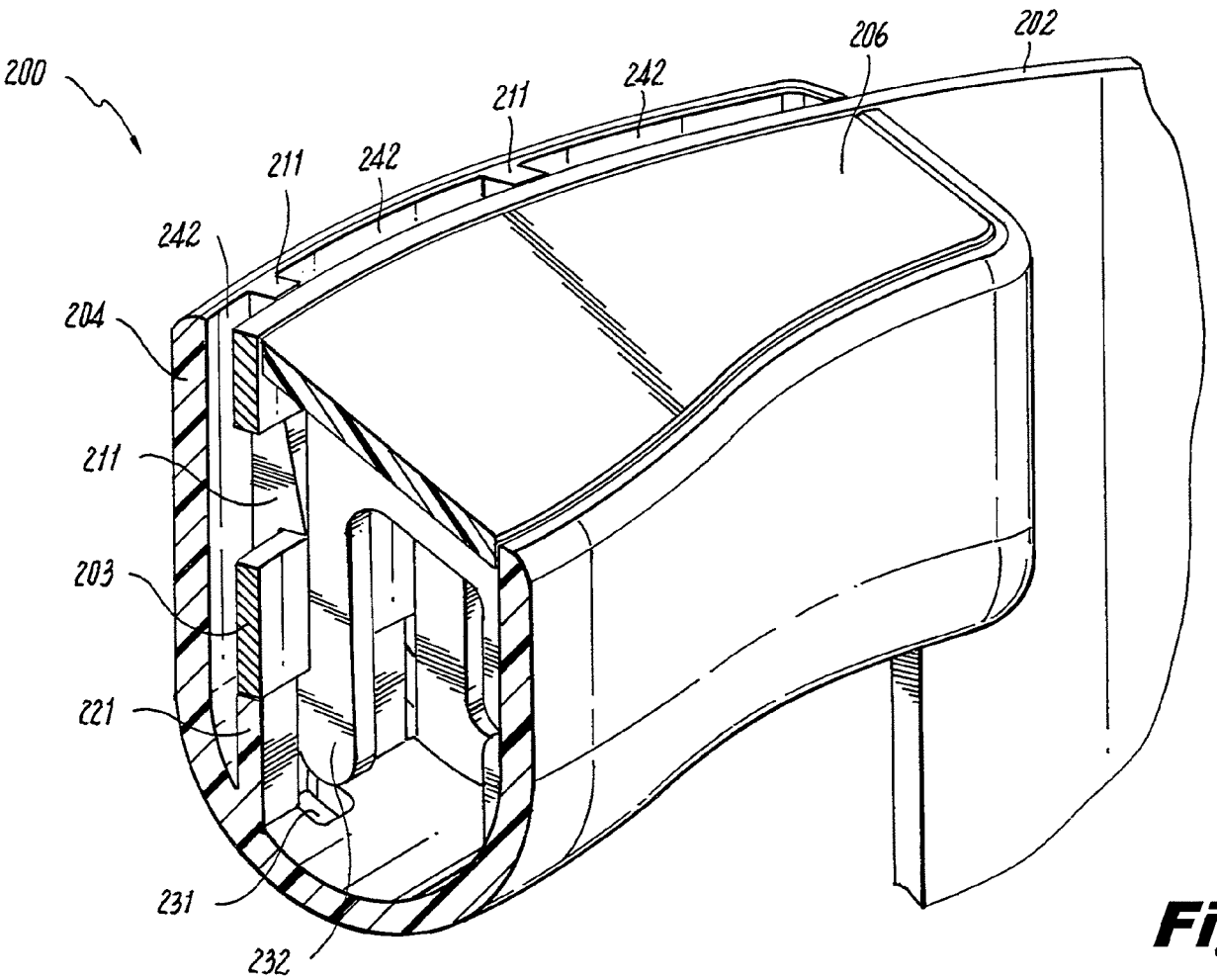
FIG. 20 is a cross-sectional perspective view of the handle, grip body, and lock member of FIG. 12, showing one of the stop surfaces of the grip body engaging the handle, preventing over engagement of the grip body with the handle.
Figure 21:
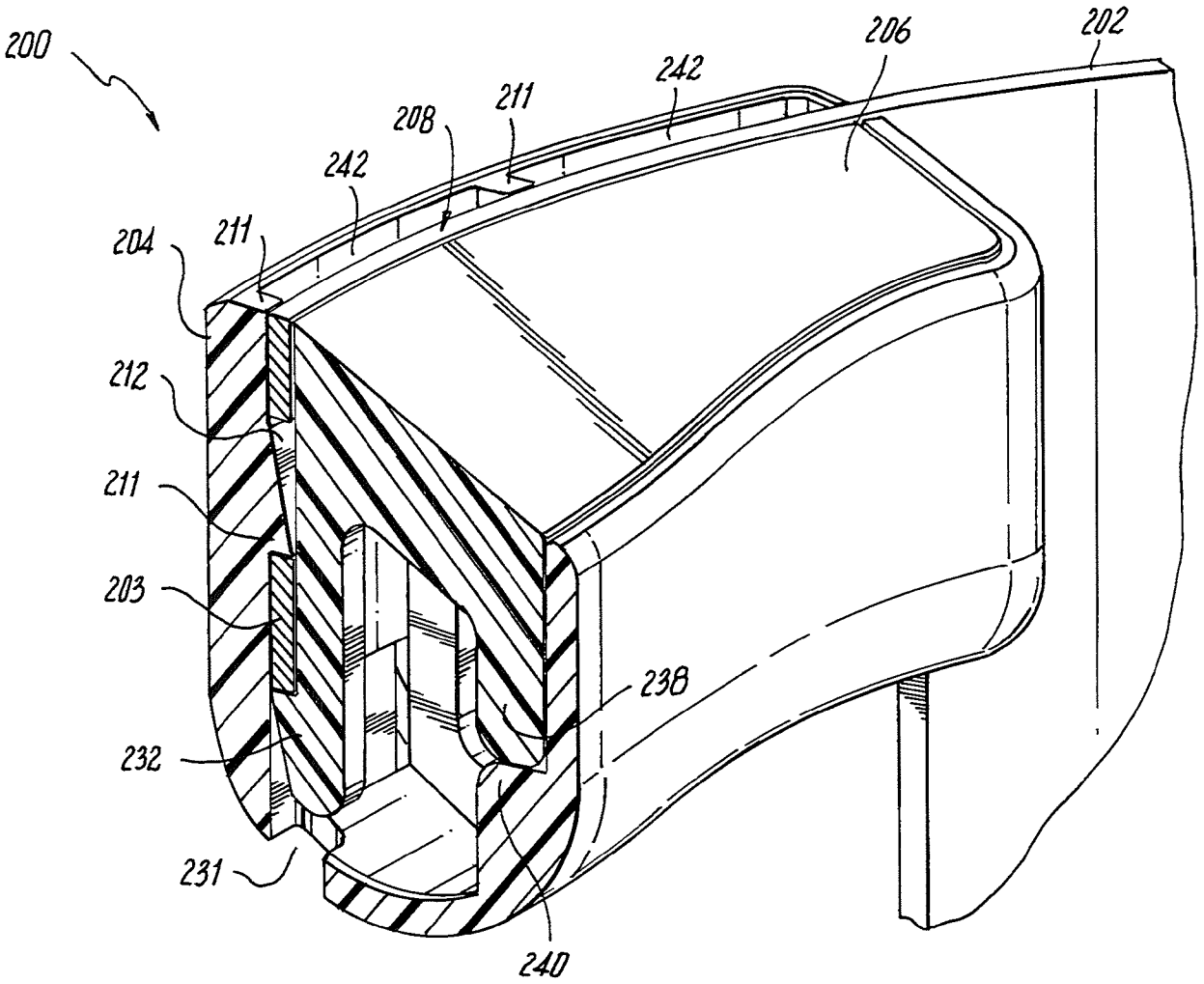
FIG. 21 is a cross-sectional perspective view of the handle, grip body, and lock member of FIG. 12, showing a clip of the grip body and a clip of the lock member each engaging the handle proximate one another.

Referring now to FIGS. 17-21, cross-sections of grip 200 are shown to demonstrate the engagement of grip 200 to handle 202. FIG. 17. shows the engagement of three of the inboard clips 210 and two of the outboard clips 211 engaging respective clip receptacles 212. An aperture 230 is provided through grip body 204 adjacent each inboard clip 210 for disengaging handle 200 from handle 202, much as described above with respect to grip 100. In FIG. 18, lock member 206 is shown inserted into grip body 204. Bulkheads 218 engage the inboard surfaces of clips 210 to lock the engagement of clips 210 in clip receptacles 212, by preventing clips 210 from backing out of receptacles 212 under load. Bulkheads 218 also each include a stopping surface 219 that engages a corresponding stopping surface on a clip 210 to prevent over engagement of lock member 206 into grip body 204, i.e., pushing lock member 206 too far into grip body 204. Grip body 204 also includes stop members 221 that engage portion 203 of handle 202 to prevent over engagement of grip body 204 with handle 202, i.e., pushing grip body 204 too far onto handle 202. FIG. 19 shows a similar cross-section to that in FIG. 18, taken at the edge of the center clip receptacle 212 and through aperture 230. FIG. 20 shows the engagement of grip body 204, handle 202, and lock member 206 at a cross-section proximate clip 232 of lock member 206, showing one of the stop members 221 of grip body 204. FIG. 21 shows a cross-section of grip 200 adjacent clip 232 of lock member 206. There is a secondary aperture 231 through grip body 204 proximate each clip 232, so that a tool can be inserted therethrough to manipulate clips 232 out of engagement with handle 202 for removal of lock member 206. Clips 232 include stop members 238, and grip body 204 includes corresponding stop members 240, which engage one another to stop over engagement of lock member 206 within grip body 204 much as described above. FIG. 21 shows how outboard clips 211 of grip body 204 and clips 232 of lock member 206 engage all around the cross-sectional perimeter of portion 203 of handle 202. When engaged together, grip body 204 and lock member 206 form a lengthwise slot 208, much like slot 108 described above.

Figure 22:
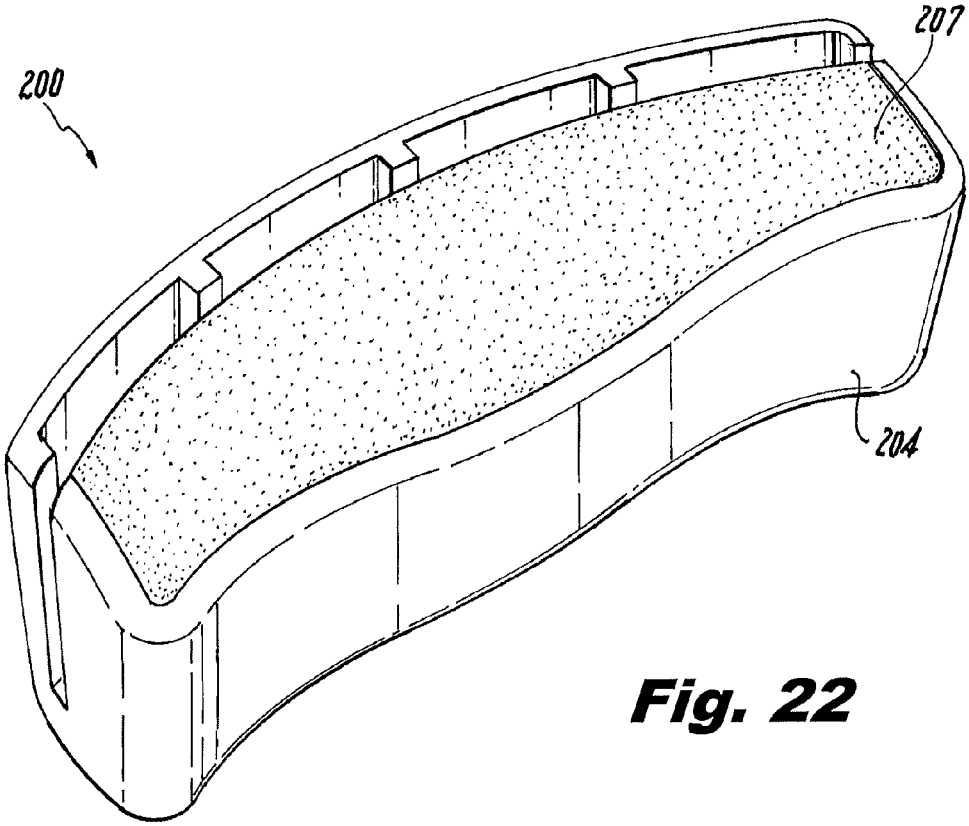
FIG. 22 is a perspective view of the grip of FIG. 21, showing the grip separate from the gas cylinder as viewed from inboard.
Figure 23:
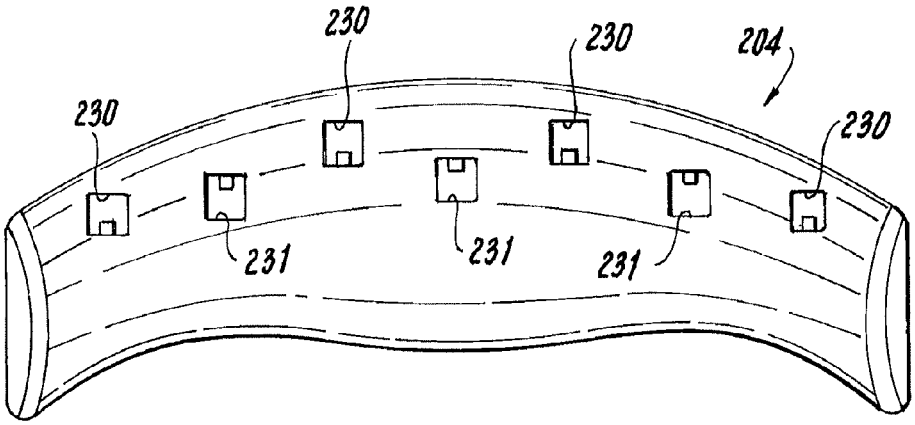
FIG. 23 is a bottom view of the grip of FIG. 22, showing the apertures through the grip body.

In addition to apertures 230 and 231 described above, FIGS. 18-21 show apertures 242 defined between the outboard wall of grip body 204 and handle 202, separated from one another by outboard clips 211. Apertures 242 are advantageous for the forming process of grip body 204, which is a molding process. Apertures 242 address mold movement considerations, for example, giving enough dimension to apertures 230, without which the mold steel, for example, might not be strong enough and could overheat. The form of some or all of apertures 230, 231, and 242 can be configured to lower mold investment and reliability of production. FIGS. 22-23 show grip 200 assembled separate from pressure cylinder 20 as viewed from inboard and from below, respectively, as oriented in FIG. 12.

Grips 100 and 200 and their constituent grip bodies and lock members can be made of plastic by injection molding. High density polyethylene (HDPE) is an exemplary plastic material contemplated for grips 100 and 200. Those skilled in the art will readily appreciate that any other suitable material and manufacturing processes can be used without departing from the spirit and scope of the invention. Grips 100 and 200 allow assembly without the need for any tool, and allow for use with a shroud having a rounded shape on the top. This can be ergonomic and can increase shock resistance, since the assembly is performed vertically (bottom to top as oriented in FIG. 1 for example).

While shown and described in the exemplary application of cylinders for storing pressurized gas, those skilled in the art will readily appreciate that grips in accordance with the invention can be used in any other suitable application. While both grips 100 and 200 are generally arcuate in their lengthwise direction to conform to underlying arcuate handles, those skilled in the art will readily appreciate that grips in accordance with the invention can also be applied in non-arcuate applications. While described above with relative directions such as inboard, outboard, upper, and lower, those skilled in the art will readily appreciate that such terms are relative to the figures provided, and that any suitable orientations or directions can be used without departing from the spirit and scope of the invention. Moreover, it is contemplated that grips in accordance with the present invention can be included on newly manufactured handles, or can be used, for example, as a kit for retrofitting existing handles to gain the improvements and advantages described herein.

The methods and systems of the present invention, as described above and shown in the drawings, provide for handle grips with superior properties including improved ergonomics and portability, effectively softening the handle and reducing the apparent weight, for pressurized gas cylinders and the like. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A cylinder for storing pressurized gas comprising:

a) a cylinder body configured and adapted to store pressurized gas, the cylinder body having a valve on a top;

b) a handle extending from the cylinder body, the handle including a shroud with a proximal end coupled to the cylinder body to surround the valve and a rounded shape on a distal end to increase strength, wherein the shroud defines a hand hold opening and at least one clip receptacle hole adjacent the hand hold opening;

c) a grip body engaged on each side of the shroud and within the hand hold opening of the handle, wherein the rounded shape is unencumbered by the grip body; and d) a lock member engaged with the grip body, locking the engagement of the grip body with the handle, wherein (i) the grip body includes a lengthwise slot for receiving the handle therein, the grip body includes a plurality of inboard clips having a first side configured to clip into the at least one clip receptacle hole in the handle from a first side of the grip body, and the lock member includes a main opening for receiving the grip body therein, and (ii) the lock member includes a plurality of clip locks each configured to engage a second side of the plurality of inboard clips, wherein the second side opposes the first side of the inboard clips, and, thereby, prevents a respective one of the inboard clips of the grip body from backing out of the respective clip receptacle hole to lock the grip body onto the handle.

2. The cylinder as recited in claim 1, wherein the handle, grip body, and lock member are arcuate in a lengthwise direction thereof.

3. The cylinder as recited in claim 1, wherein the grip body includes a plurality of stop surfaces configured to abut the handle to prevent over engagement of the grip body with the handle.

4. The cylinder as recited in claim 1, wherein a plurality of apertures are defined through at least one of the grip body and the lock member for accommodating a tool to disengage one or more of the grip body and lock member.

5. The cylinder as recited in claim 1, wherein the grip body includes a plurality of stop surfaces, wherein the lock member includes a plurality of stop surfaces, wherein each stop surface of the grip body is configured to abut a corresponding one of the stop surfaces of the lock member to prevent over engagement of the lock member with the grip body.

6. The cylinder as recited in claim 1, wherein the first and second side of the inboard clips is radially inward of the shroud.

7. The cylinder as recited in claim 1, further comprising a base on a bottom of the cylinder body that is complimentarily shaped to the rounded shape to allow stacking on a second cylinder of a same shape.

8. A pressurized gas cylinder comprising:

a) an elongated cylinder body for storing pressurized gas;

b) a valve coupled to a top end of the cylinder body for filling and emptying the cylinder body; and c) a handle extending from the top end of the cylinder body around the valve, the handle including:

i) a shroud for protecting the valve, the shroud having a rim defining a hand hold opening, the shroud defining at least one clip receptacle hole located distally above the hand hold opening; and ii) a grip for providing an ergonomic surface in the hand hold opening, the grip having:

A) a grip body defining a lengthwise slot for coupling to the rim within the hand hold opening, the grip body having at least one clip with an upper clip portion that protrudes into the lengthwise slot for coupling to the at least one clip receptacle hole, the at least one clip terminating in a clip end; and B) a lock member for coupling to the grip body, the lock member having: an exterior that provides the ergonomic surface; an interior for receiving the grip body; and at least one clip upstanding within the interior and positioned opposing to the at least one clip to selectively engage the clip end and, in turn, couple the lock member to the grip body and prevent the upper clip portion from releasing from the at least one clip receptacle.

9. The pressurized gas cylinder as recited in claim 8, wherein the clip end of the at least one clip terminates in an arrow-head shape.

10. A pressurized gas cylinder comprising:

a) an elongated cylinder body for storing pressurized gas;

b) a valve coupled to a top end of the cylinder body for filling and emptying the cylinder body; and c) a handle extending from the top end of the cylinder body around the valve for protecting the valve, the handle including:

i) a shroud defining a hand hold opening and a clip receptacle hole adjacent the hand hold opening; and ii) a grip coupled in the hand hold opening and the clip receptacle hole, the grip having: a grip body defining a slot for coupling to the shroud, the grip body having a clip that protrudes into the clip receptacle hole; and a lock member that: provides an ergonomic surface for gripping by a user; and includes a clip retainer to selectively engage the clip for retention in the clip receptacle hole.

* * * * *